US006389608B1

(12) United States Patent
Williams

(10) Patent No.: US 6,389,608 B1
(45) Date of Patent: May 21, 2002

(54) SOCCER HEADGEAR

(76) Inventor: Calvin Williams, 1100 Nasa Rd. 1, Suite 401, Nassau Bay, TX (US) 77058

( * ) Notice: Subject to any disclaimer, the term of this patent is extended or adjusted under 35 U.S.C. 154(b) by 0 days.

(21) Appl. No.: 09/685,751

(22) Filed: Oct. 10, 2000

Related U.S. Application Data

(60) Provisional application No. 60/158,075, filed on Oct. 7, 1999.

(51) Int. Cl.[7] ..... A63B 71/10
(52) U.S. Cl. ..... 2/425; 2/411
(58) Field of Search ..... 2/410, 411, 412, 2/425

(56) References Cited

U.S. PATENT DOCUMENTS

| | | | | |
|---|---|---|---|---|
| 1,483,881 | A | * | 2/1924 | Hart |
| 3,551,911 | A | * | 1/1971 | Holden |
| 4,058,854 | A | * | 11/1977 | Rhee |
| 4,279,038 | A | * | 7/1981 | Bruckner et al. |
| 4,646,367 | A | | 3/1987 | El Hassen ..... 2/411 |
| 4,698,852 | A | | 10/1987 | Romero ..... 2/171 |
| 4,706,305 | A | * | 11/1987 | Cho |
| 4,947,488 | A | | 8/1990 | Ashinoff ..... 2/181 |
| 4,982,451 | A | | 1/1991 | Graham ..... 2/410 |
| 5,177,815 | A | * | 1/1993 | Andujar |
| 5,271,103 | A | * | 12/1993 | Darnell |
| 5,392,468 | A | * | 2/1995 | Leddick, III |
| 5,713,082 | A | * | 2/1998 | Bassette et al. |
| 5,768,715 | A | | 6/1998 | Gregg, III et al. ..... 2/411 |
| 5,790,988 | A | | 8/1998 | Guadagnino, Jr. et al. ..... 2/411 |
| 5,930,841 | A | | 8/1999 | Lampe et al. ..... 2/411 |
| 5,946,734 | A | * | 9/1999 | Vogan |

FOREIGN PATENT DOCUMENTS

| | | | |
|---|---|---|---|
| DE | 3632525 | * | 3/1988 |
| GB | 2220556 | * | 1/1990 |
| GB | 2333690 | * | 8/1999 |
| WO | 8501665 | * | 4/1985 |

* cited by examiner

*Primary Examiner*—Rodney M. Lindsey
(74) *Attorney, Agent, or Firm*—Jo Katherine D'Ambrosio

(57) ABSTRACT

Protective headgear for protecting the head of an athlete comprising a circumferential band, two subtending ear flaps integrally molded to the circumferential band, an upper portion; and a header pad affixed to the circumferential band. Alternatively the protective headgear for a soccer player can comprise a helmet defining ventilation holes and a header pad affixed to a frontal area of the helmet. The helmet comprises a circumferential band, two integral ear flaps; an upper portion; and a header pad is affixed to the circumferential band. The protective headgear can further comprise an internal skeletal to help disperse sudden high energy impacts.

13 Claims, 9 Drawing Sheets

SOCCER HEADGEAR

CROSS REFERENCES TO RELATED CASES

This is a continuation of U.S. Provisional Patent Application, Ser. No. 60/158,075 filed Oct. 7. 1999, now abandoned.

FIELD OF THE INVENTION

The present invention relates to protective headgear for athletics. More particularly, the present invention relates to a protective head guard for soccer players.

BACKGROUND OF THE INVENTION

Protective headgear has long been used in various athletic events. For example, football players and baseball players wear helmets to protect themselves from blows to the head. Similarly, hockey players have now begun to protect themselves with helmets. More recent, recreational sports such as bicycling have an increasing number of participants wearing protective headgear.

Traditionally, soccer players have not worn any protective headgear. One of the reasons for the lack of protective headgear in soccer has been the perception that injuries to the head are not as commonplace as in sports such as football, baseball, hockey and bicycling. However, recent medical research has demonstrated that head injuries may be more prevalent in soccer than previously thought. In addition to injuries resulting from a single blow to the head, several studies have suggested that soccer players may suffer minor trauma from repeatedly heading the ball. The minor trauma has been analogized to "pugilistic dementia," which boxers suffer from as a result of repeated strikes to the head. Alf Thorvald Tysvaer, *Head and Neck Injures in Soccer—Impact of Minor Trauma,* Sports Medicine, 14(3): 200–213 (1992). The danger of trauma is increasingly significant with respect to children whose bodies may not be developed enough to properly withstand or counteract the blow caused by a ball. Id. at 210. Thus, there is a need, at least from a safety standpoint, for headgear for use by soccer players.

However, soccer is one of the few sports in which the head is intentionally and frequently used to strike the ball. Thus, the unique demands of the sport require a uniquely designed headgear. The types of headgear used in football, baseball, hockey and bicycling are not suitable for use in soccer. For example, football and baseball helmets are extremely bulky and would deter soccer players from using them. Hockey helmets, although less bulky then football and baseball helmets, are comprised of uneven surfaces that would make it difficult to control the direction and distance of a headed ball. Bicycle helmets are light but the uneven surfaces would make header control difficult. Further, bicycle helmets are built to withstand but one substantial blow.

Several patents have been directed to headgear designed for use in soccer. For example, U.S. Pat. No. 4,698,852 to Romero (the '852 patent) discloses a head guard for minimizing injury resulting from the forehead of the player contacting the ball. However, the apparatus disclosed in the '852 patent only protects the forehead of the wearer. Not only does the apparatus of the '852 patent neglect other parts of the head which may be used, properly or improperly, to strike balls, but it also fails to protect other parts of the head from injurious incidental contact such as accidentally striking another player's head or striking the goal post. Further, the design of the '852 patent would likely result in the headgear slipping up or down on the wearer's head during play. There is, therefore, a need to provide soccer headgear that protects all parts of the head and that does not slip during play.

U.S. Pat. No. 5,930,841 to Lampe et al. (the '841 patent) discloses a soccer headguard intended to overcome the shortcomings of the prior art. The '841 patent is comprised of essentially a two-ply stretchable material with pockets formed within the plies for insertion of foam pads. The foam pads may be positioned to provide protection for the portions of a player's head which generally come in contact with a soccer ball. Because the foam pads are simply inserted into pockets formed within the plies, there is the possibility of the pads displacing upon repeated contact. In order to prevent displacement of the pads within the pockets during play, the two-ply stretchable material must be stretched tight by constriction of the chin strap. The required chin strap restriction would result in player discomfort. Thus, there exists a need to provide soccer headgear that offers protection for the portions of a player's head which come in contact with a soccer ball without the possibility of displacement of the protective padding and without unnecessarily discomforting the player.

BRIEF DESCRIPTION OF THE DRAWINGS

FIG. 7 is a perspective view of a preferred embodiment of the soccer headgear of the present invention.

DETAILED DESCRIPTION OF THE PREFERRED EMBODIMENT

Figure 1:
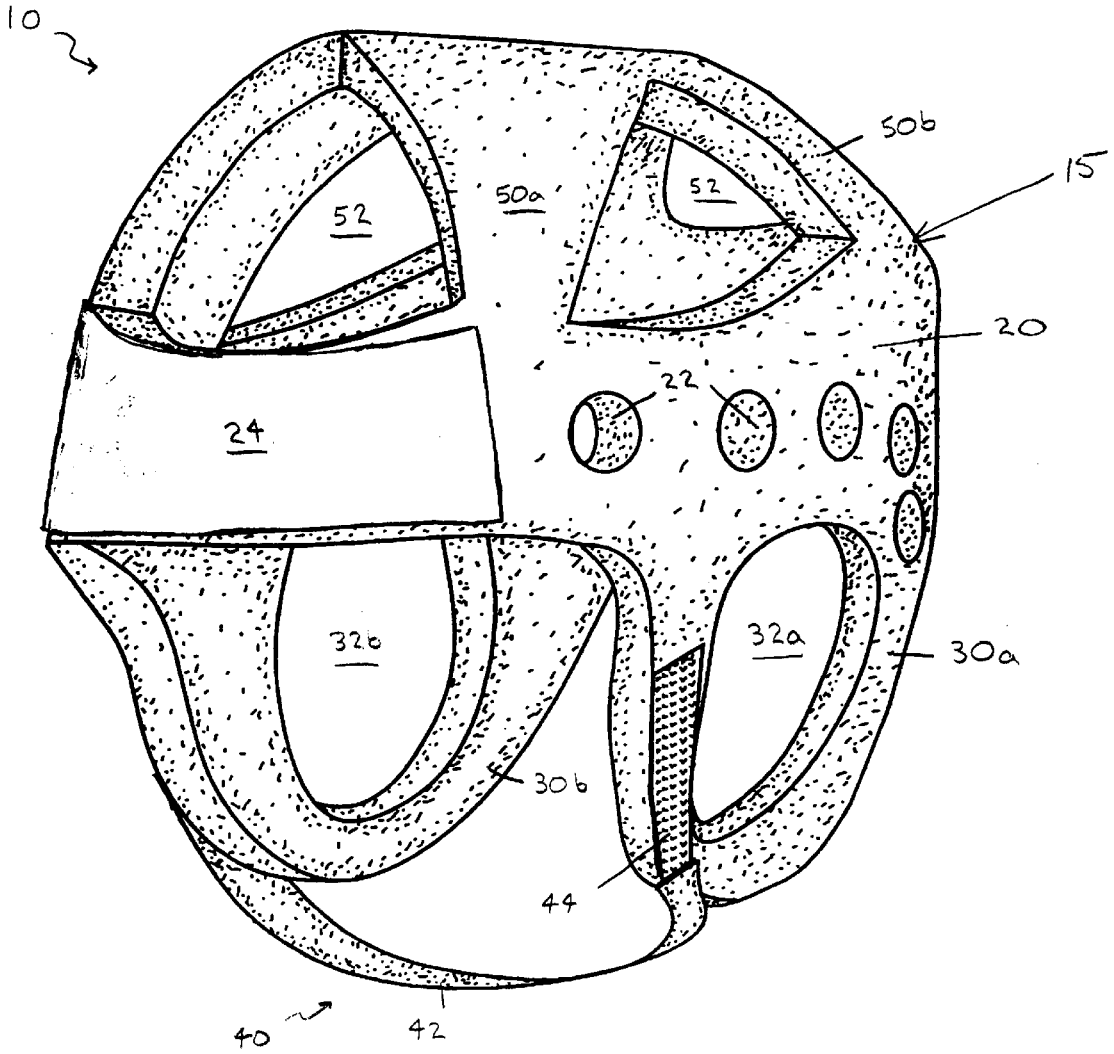
FIG. 1 is a perspective view of a preferred embodiment of the soccer headgear of the present invention
Figure 2:
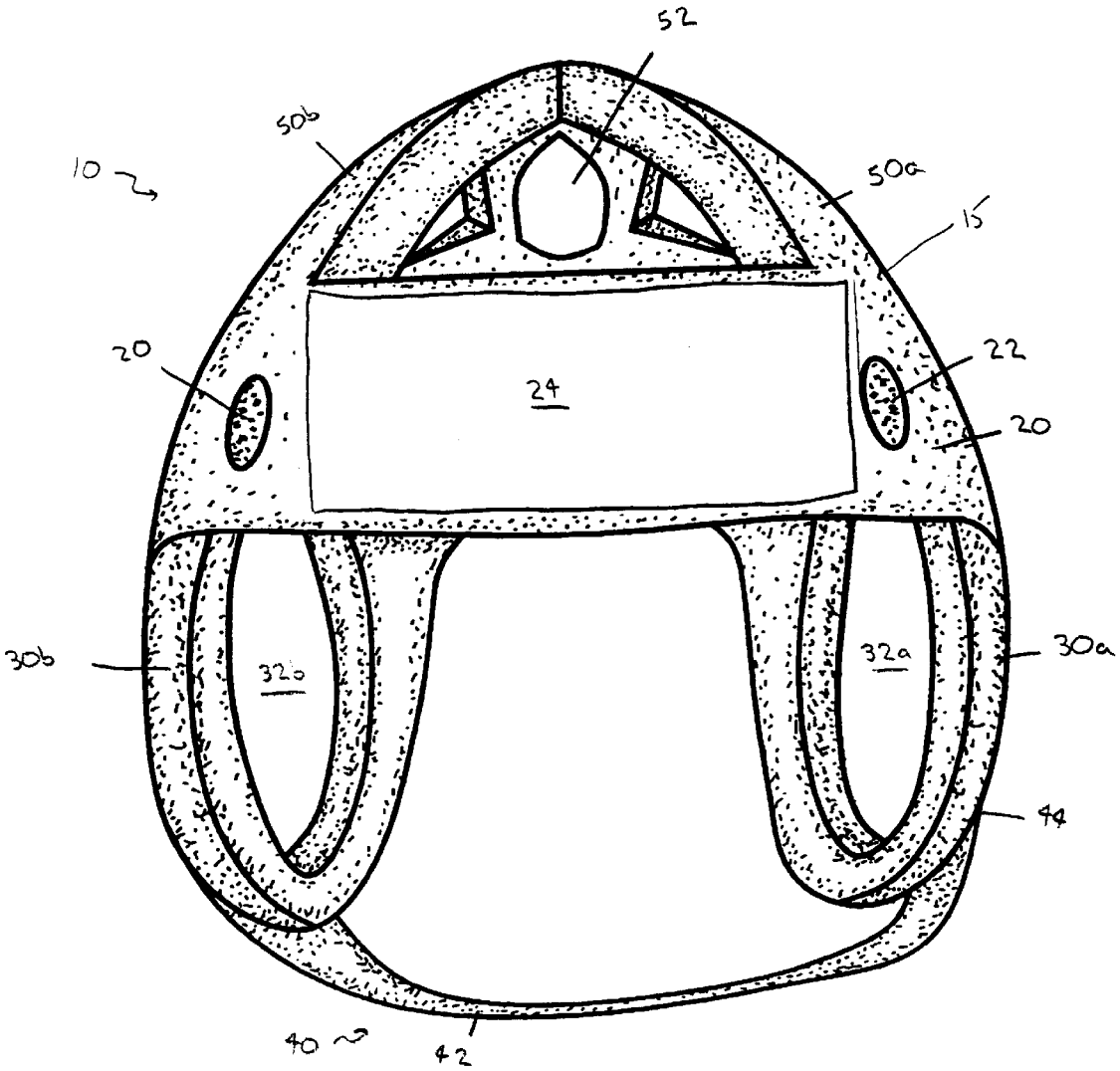
FIG. 2 is a front elevational view of a preferred embodiment of the soccer headgear of the present invention.
Figure 3:
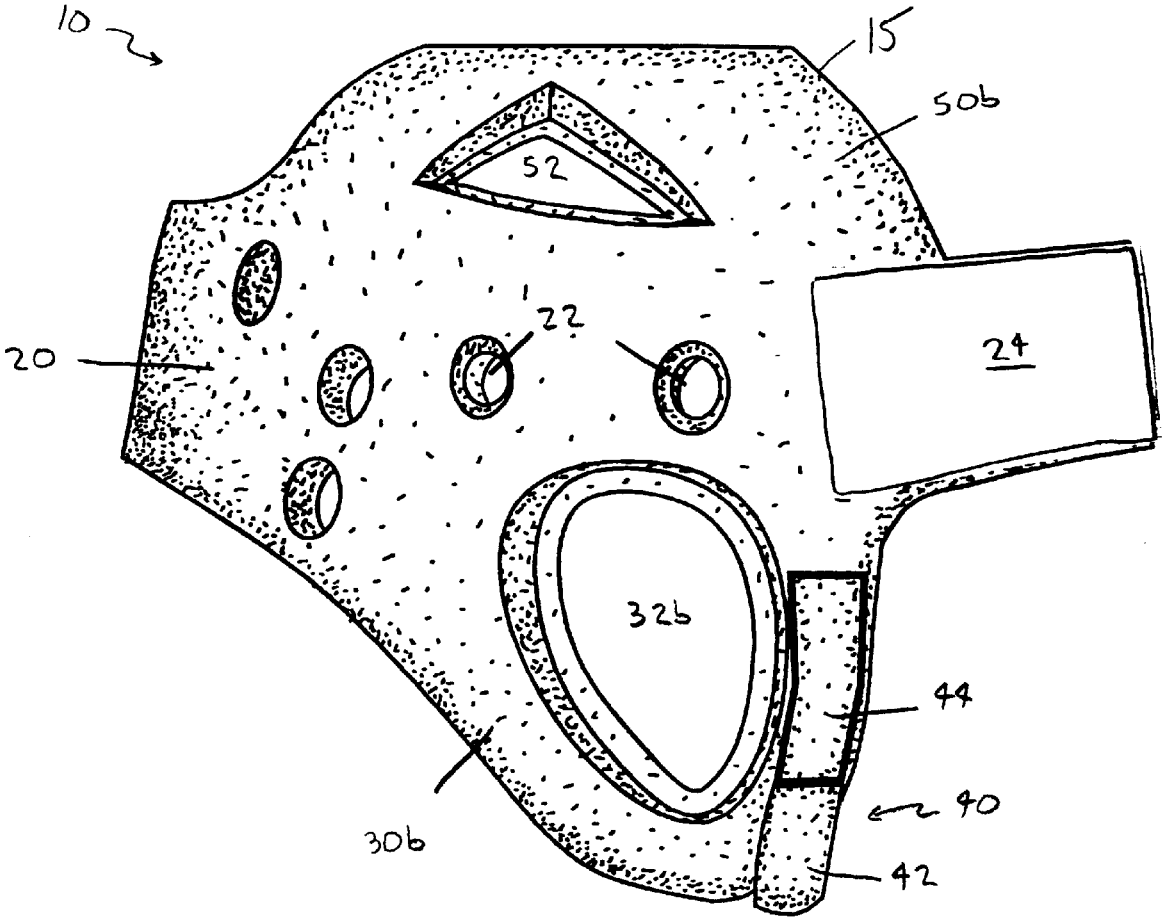
FIG. 3 is a side elevational view of a preferred embodiment of the soccer headgear of the present invention.
Figure 4:
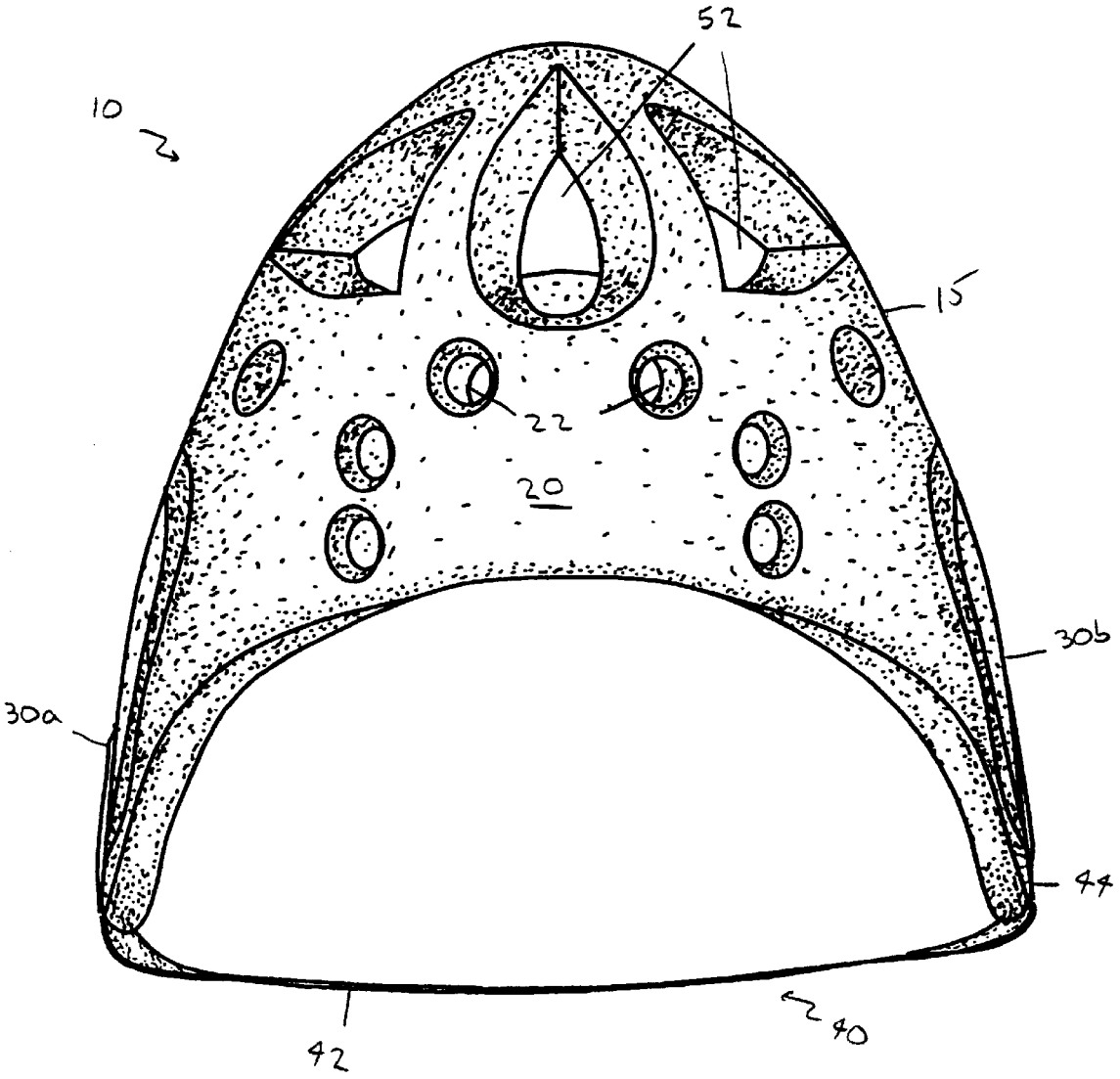
FIG. 4 is a rear elevational view of a preferred embodiment of the soccer headgear of the present invention.

A preferred embodiment of the present invention relates to protective headgear for athletes. More particularly, a preferred embodiment of the present invention relates to a protective head guard for soccer players. However, although discussed with reference to headgear for soccer players, one skilled in the art will recognize that the present invention is applicable for participants in athletics generally.

FIGS. 1–6 illustrate a preferred embodiment of the soccer headgear 10 of the present invention. In one preferred embodiment of the soccer headgear 10, the headgear 10 comprises a helmet 15 comprising several components that are integral with each other. The components include, but are not limited to, a circumferential band 20, ear flaps 30*a* and 30*b*, a chin strap 40 and crossing members 50*a* and 50*b*. A header pad 24 can be detachably affixed to the headgear 10 or integral with the circumferential band 20.

The components of one preferred embodiment of the present invention are preferably unitarily molded from a suitable resilient material, capable of absorbing energy. Preferably, the resilient material is polystyrene or polyurethane foam. However, one skilled in the art will recognize that other suitable materials such as synthetic rubber foam can be used to advantage and still remain within the purview of the invention. A suitable outer surface coating covers the entire outer surface of the resilient material. In a preferred embodiment, the coating is a tough, pliable, tear resistant plastic material that can be formed during heating and molding of resilient foam to produce a fused coating. However, one skilled in the art will recognize that the surface coatings can be applied by laminating, dipping, brushing or spraying and still remain within the purview of the invention. Further, one skilled in the art will recognize that, alternatively, the soccer headgear 10 can be manufactured from harder, more rigid materials, plastics for example.

The chassis of the soccer headgear 10 of one preferred embodiment of the present invention is a circumferential band 20. The circumferential band 20 forms a continuous protective band around the forehead, temples, and the back of the head. The circumferential band 20 defines a plurality of ventilation holes 22 located along its circumference. The ventilation holes 22 provide adequate ventilation to ensure comfort to the wearer of the soccer headgear 10. It should be noted that one skilled in the art would recognize that any number of ventilation holes 22 could be utilized and is remain within the purview of the invention. Further, one skilled in the art will recognize that it is not necessary to have any ventilation holes 22.

Also located along the circumferential band 20 of a preferred embodiment of the present invention is a header pad 24. The header pad 24 is a strip of suitable resilient material that provides additional protection for the forehead region of the head to guard against the injurious consequences resulting from continuous impact with the soccer ball. The header pad 24 is comprised of a material whose outer surface frictionally contacts the soccer ball to dissipate the rotational force of the ball and facilitate control of the ball by the player. In one preferred embodiment of the present invention, the header pad 24 is affixed to the circumferential band 20 of the soccer headgear 10 by an adhesive. However, one skilled in the art will recognize that the header pad 24 can be affixed to the soccer headgear 20 by any number of means such as velcro stripping, taping, etc. In an alternative embodiment, the header pad 24 is integral with the chassis. In another preferred embodiment, the header pad 24 can be manufactured integrally with the headgear 10 either internally within the band 20 of the headgear in the region of the forehead or externally on the outside portion of the band 20, away from the player's head. Alternatively, as illustrated in FIG. 8*a*, an internal armor plate or skeleton 70 is used to help disperse sudden high energy impact loads that may occur by bumping heads, balls or accidental kicks to the head. The internal skeleton 70 can comprise individual plates within the circumferential band 20 and other parts of the headgear 10 or one continuous skeleton 70 throughout the internal structure of the headgear 10.

Preferably, a set of ear flaps 30*a* and 30*b* extend down from the circumferential band 20. The ear flaps 30*a* and 30*b* have openings 32*a* and 32*b* which generally outline the ears for hearing purposes. The ear flaps 30*a* and 30*b* also provide additional protection to the player along the side of the head. The ear flaps 30*a* and 30*b* absorb much of the force resulting from a ball striking the ear region of the player which reduces the risks involved with a direct strike to the ear.

In a preferred embodiment of the present invention, a chin strap 40 for securing the soccer headgear to the wearer's head is affixed to one of the ear flaps 30*a* or 30*b*. The chin strap 40 is comprised of a band 42 and securing means 44. In a preferred embodiment of the present invention, the band 42 is formed from a stretchable material that provides sufficient resistance to secure the soccer headgear 10 to the wearer's head under normal conditions, and is able to stretch to absorb forces pulling the soccer headgear 10 away from the head. Without suitable stretchability, such forces could result in the band 42 restricting the wearer's breathing or cutting into the wearer's neck or chin.

In a preferred embodiment, the band 42 is permanently affixed to one of the ear flaps 30*a* or 30*b*. For purposes of illustration, in FIG. 1, the band 42 is permanently affixed to ear flap 30*b*. However, one skilled in the art will recognize that the particular ear flap 30*a* or 30*b* to which the band 42 is permanently affixed is of no significance. In use, the band 42 is secured to the opposite ear flap 30*b* by the securing means 44. The securing means 44 comprises a velcro fastener affixed to a mating piece of velcro affixed to the ear flap 30*b*. It should be noted that although the securing means 44 in the preferred embodiment of the present invention comprises a velcro fastener. In alternative embodiments, any number of suitable fasteners such as buckles or clasps may be utilized and remain within the purview of the invention. In a further alternative embodiment, both ends of the band 42 can be permanently affixed to the ear flaps 30*a* and 30*b*. In still a further embodiment, depending upon its intended use, it is not necessary that the soccer headgear of the present invention have a chin strap 40.

Figure 5:
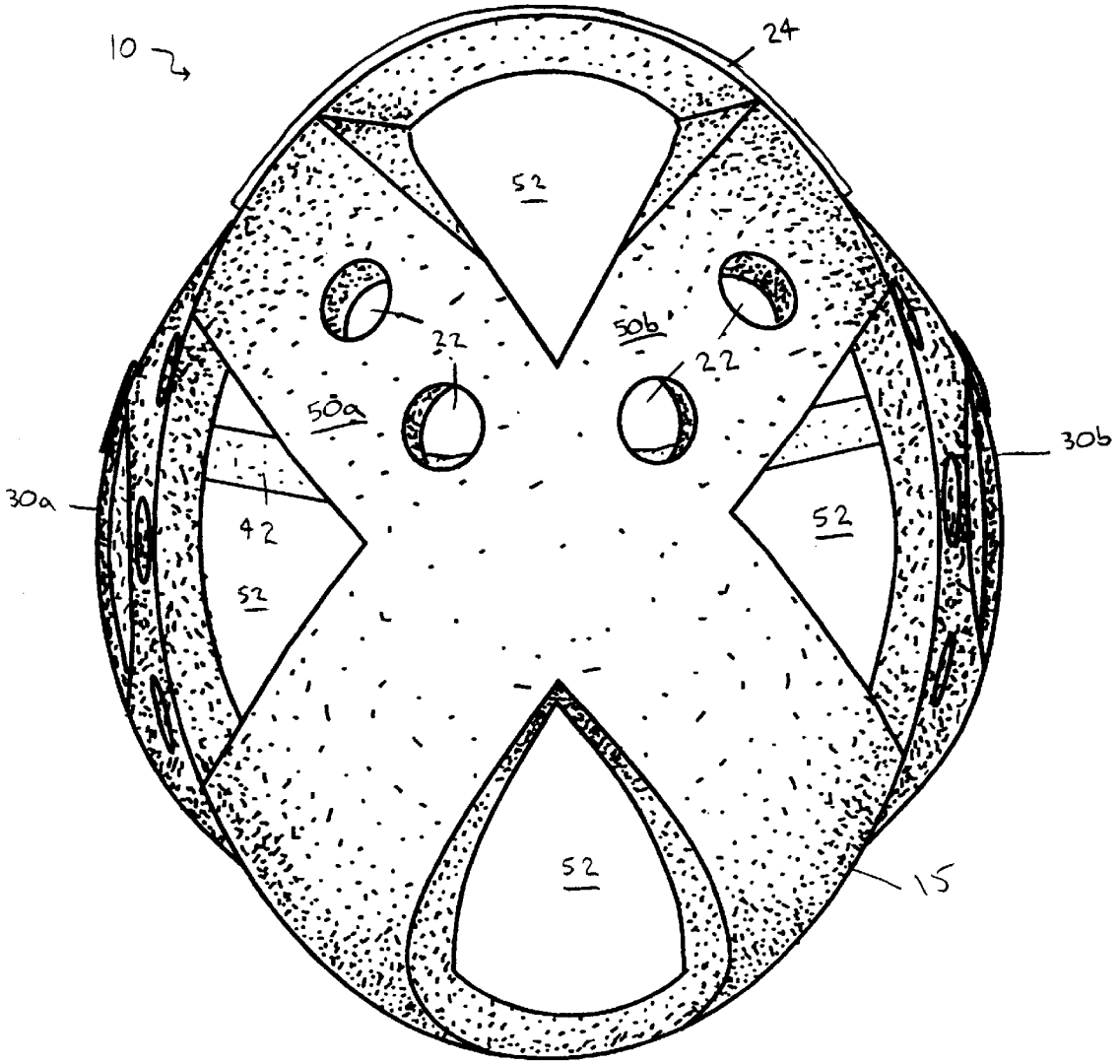
FIG. 5 is a top view of a preferred embodiment of the soccer headgear of the present invention.
Figure 6:
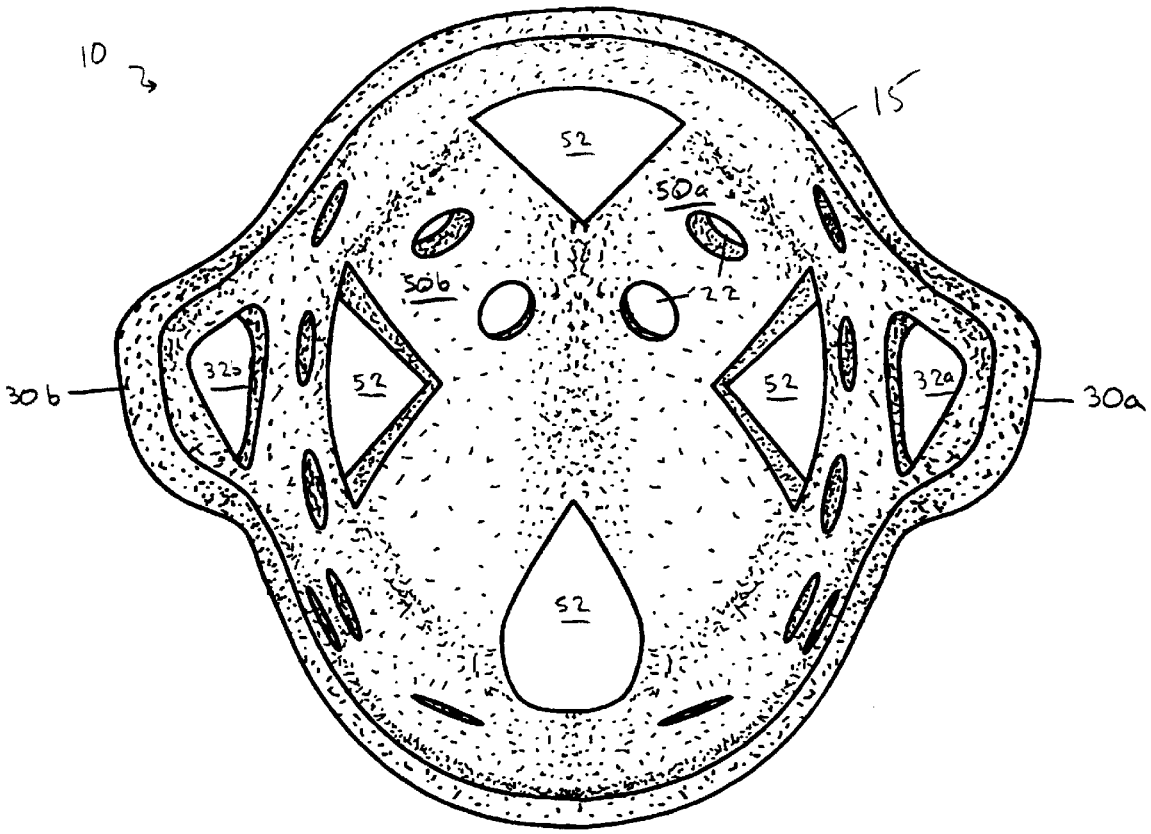
FIG. 6 is a bottom view of a preferred embodiment of the soccer headgear of the present invention.

As best illustrated in FIG. 5, a top view of a preferred embodiment of the present invention, crossing members 50*a* and 50*b* form the top of the soccer headgear. The crossing members 50*a* and 50*b* provide protection for the upper portions of the head. In a preferred embodiment of the present invention, the crossing members 50*a* and 50*b* define a series of ventilation holes 22. As discussed with reference to the circumferential band 20, one skilled in the art will recognize that the crossing members 50*a* and 50*b* can have any number of ventilation holes 22 and remain within the purview of the invention. Further, one skilled in the art will recognize that it is not necessary to have any ventilation holes 22. The ventilation holes 22 are only intended to provide additional comfort to the wearer. In the further interest of comfort, the crossing members 50*a* and 50*b* further define ventilation openings 52. These ventilation openings 52 facilitate ventilation and cooling of the wearer's head by placing the wearer's head in substantial communication with the outside air. The large ventilation openings 52 are used to particular advantage when the soccer headgear 10 is being worn by smaller children. When the soccer headgear 10 is worn by small children, the major concerns are safety and comfort (to encourage the headgear's use) rather than providing a uniform surface to accurately direct the ball.

Figure 7A:
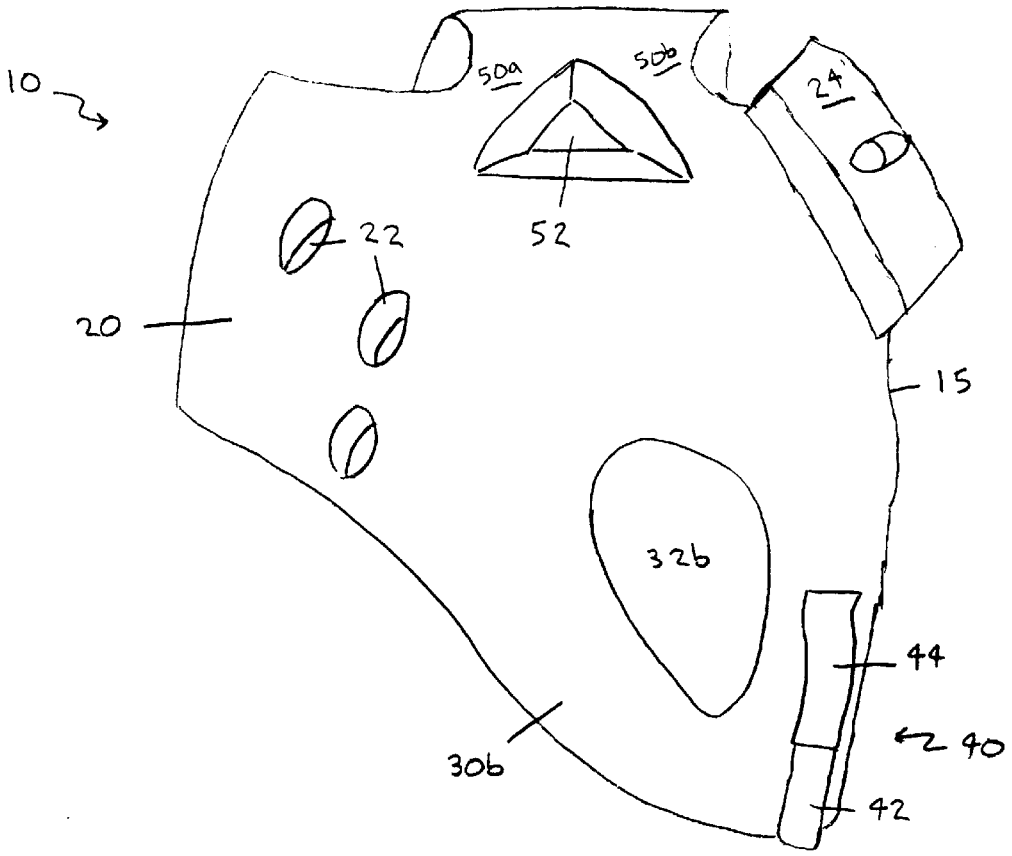
FIG. 7A is a side elevational view of one preferred embodiment of the soccer headgear of the present invention.
Figure 7B:
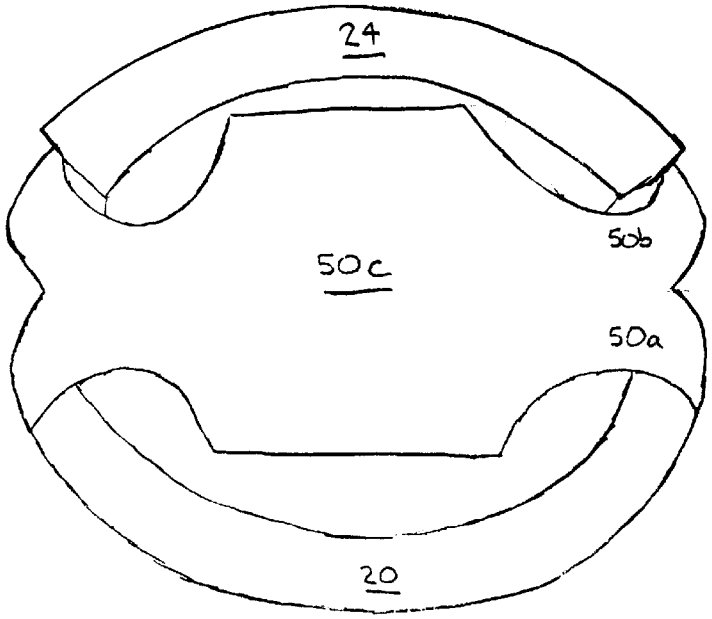
FIG. 7B is a top view of another preferred embodiment of the soccer headgear of the present invention.

An alternate preferred embodiment of the soccer headgear 10 of the present invention is shown in FIGS. 7A and 7B. In this alternate embodiment, the header pad 24 is integral with the circumferential band 20. The integral header pad 24 has a series of ventilation holes 22 to provide ventilation to the athlete's forehead. Further, in the alternate embodiment shown in FIGS. 7A and 7B, the crossing members 50*a* and 50*b* intersect in an upper pad 50*c* which provides increased protection of the top of the head and provides a smoother surface to control balls striking the top of the head.

Figure 8:
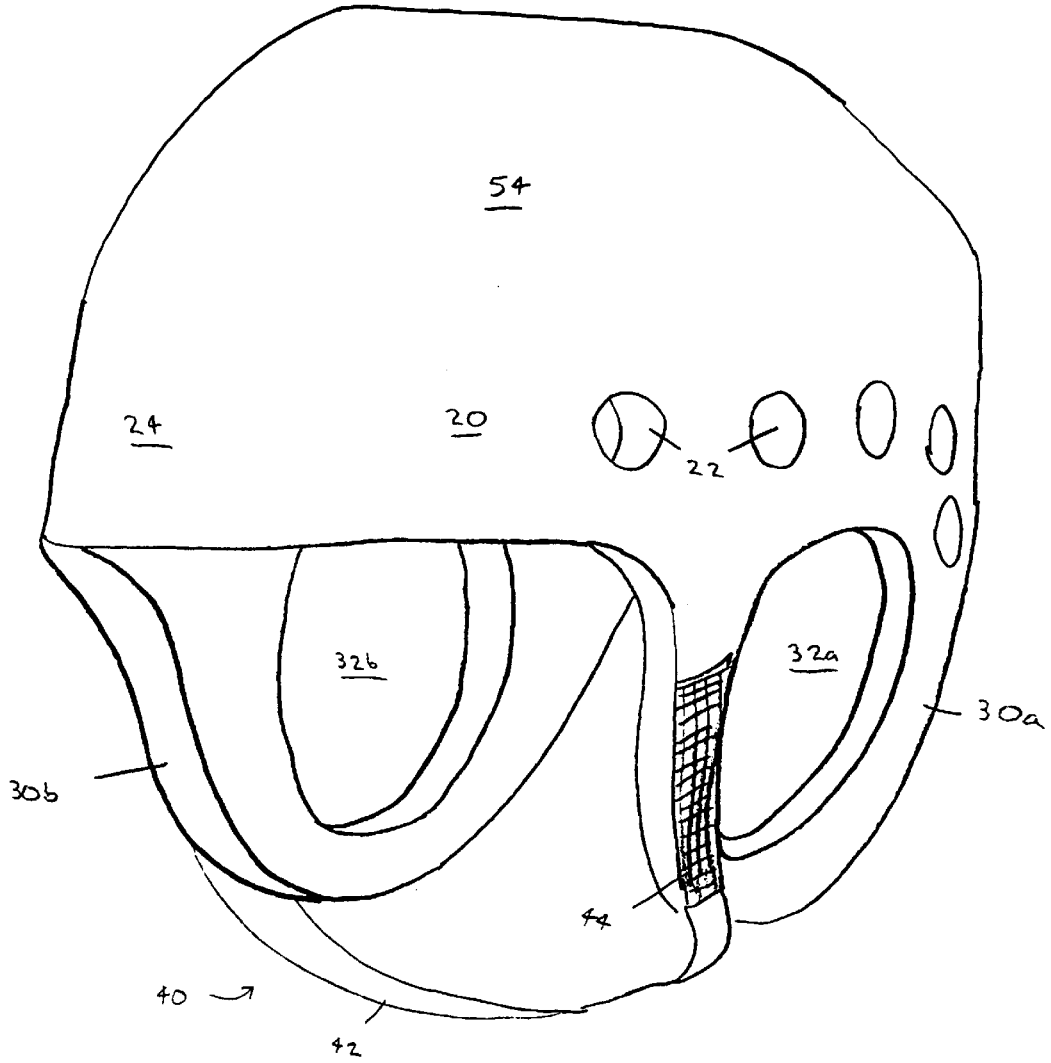
FIG. 8 is a perspective view of one preferred embodiment of the soccer headgear of the present invention.
Figure 8A:
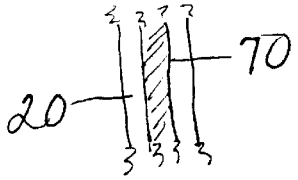
FIG. 8A is a cross-section of the internal armor plate or skeleton of one preferred embodiment of the soccer headgear of the present invention.

Yet another alternate preferred embodiment of the soccer headgear 10 of the present invention is shown in FIG. 8. In this alternate embodiment, the header pad 24 is integral with the circumferential band 20, but less protruding than other embodiments. Having the header pad 24 integral results in a smoother surface by eliminating protruding edges of the header pad 24. The integral header pad 24 results in a smoother surface from which to head the ball and eliminates the risk of misdirected balls as a result of striking an edge of the header pad 24. The integral pad 24 can be more advantageous for the higher skilled players. In the alternate embodiment shown in FIG. 8, the helmet 15 is devoid of the ventilation openings 52. The uppermost surface 54 of the soccer headgear 10 is completely closed forming a smooth surface to accurately direct the headed ball. In this alternate embodiment, ventilation is provided by the ventilation holes 22 located along the circumferential band 20.

Figure 9:
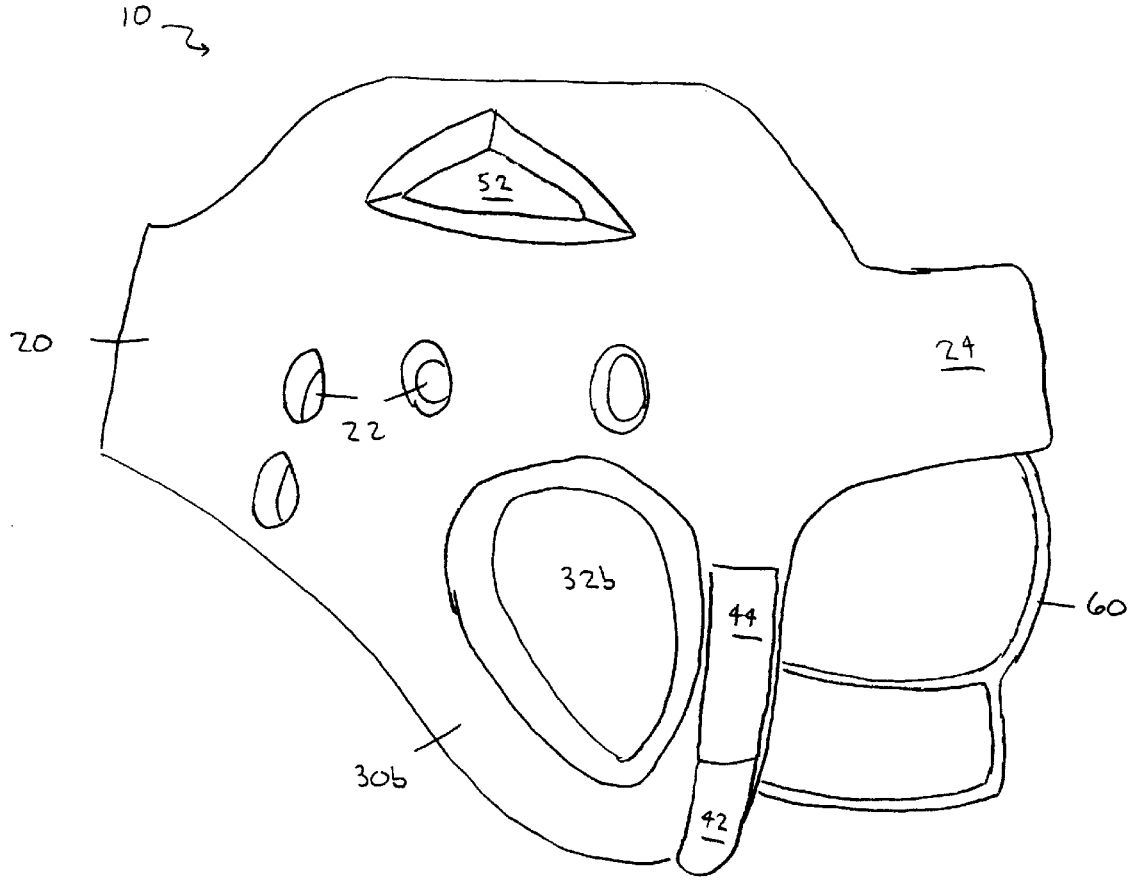
FIG. 9 is a side elevational view of another preferred embodiment of the soccer headgear of the present invention.

Yet still another alternate preferred embodiment of the soccer headgear 10 of the present invention is shown in FIG. 9. This alternate embodiment includes a protective mask 60. The protective mask 60 is particularly advantageous for athletes such as soccer goalkeepers who have a increased risk of contact by the ball or other players directly to the face.

In this alternate embodiment, the protective mask 60 is detachably affixed to the soccer headgear 10. However, in an alternate embodiment, the protective mask 60 can be integrally attached. Further, one skilled in the art will recognize that the configuration of the protective mask 60 can vary depending upon the intended use.

Although described in terms of the preferred embodiments shown in the figures, those skilled in the art who have the benefit of this disclosure will recognize that changes can be made to the individual component parts thereof which do not change the manner in which those components function to achieve their intended result. For instance, the ventilation holes 22 located along the circumferential band 20 need not be circular openings. Other embodiments of the ventilation holes 22 can be utilized to achieve the desired function. It is only necessary that the ventilation holes 22 be capable of facilitating the influx of air to the wearer of the helmet. All such changes are intended to fall within the scope of the following non-limiting claims.

What is claimed is:

1. A protective headgear for protecting the head of an athlete comprising:

a circumferential band;

two subtending ear flaps integral with the circumferential band;

an upper portion defining one or more ventilation openings; and a header pad affixed to the circumferential band.

2. The protective gear of claim 1 further comprising an internal skeleton, the internal skeleton integral with the circumferential band.

3. The protective gear of claim 2 wherein the internal skeleton comprises one or more internal armor plates.

4. A protective headgear for protecting the head of an athlete comprising:

a circumferential band adapted to encompass the lateral circumference of a wearer's head, a header pad affixed to the circumferential band, the header pad adapted to be proximate the forehead of the wearer, two ear flaps integral with the circumferential band;

an upper portion; and one or more crossing members integral with the circumferential band to form a top of the headgear.

5. A protective headgear for a soccer player comprising:

a helmet defining ventilation holes; and a header pad affixed to a frontal area of the helmet.

6. The headgear of claim 5 wherein the helmet comprises a circumferential band, two integral ear flaps; and an upper portion.

7. The headgear of claim 5 wherein the header pad is affixed to the circumferential band.

8. The headgear of claim 5 wherein the header pad is integral with the helmet.

9. The headgear of claim 5 further comprising an internal skeleton.

10. The headgear of claim 6 wherein the helmet further comprises an internal skeleton, the internal skeleton integral with the circumferential band.

11. The protective gear of claim 10 wherein the internal skeleton comprises one or more internal armor plates.

12. The headgear of claim 5 wherein the helmet comprises an internal skeleton, the internal skeleton integral with the helmet.

13. The protective gear of claim 12 wherein the internal skeleton comprises one or more internal armor plates.

* * * * *